US010683776B2

(12) United States Patent
Burg et al.

(10) Patent No.: US 10,683,776 B2
(45) Date of Patent: Jun. 16, 2020

(54) DEVICE AND METHOD FOR CONVERTING HEAT INTO MECHANICAL ENERGY

(71) Applicant: International Business Machines Corporation, Armonk, NY (US)

(72) Inventors: Brian Burg, Zurich (CH); Bruno Michel, Zurich (CH); Chin Lee Ong, Horgen (CH); Stephan Paredes, Zurich (CH); Patrick Ruch, Jenins (CH)

(73) Assignee: International Business Machines Corporation, Armonk, NY (US)

( * ) Notice: Subject to any disclaimer, the term of this patent is extended or adjusted under 35 U.S.C. 154(b) by 238 days.

(21) Appl. No.: 15/105,000

(22) PCT Filed: Dec. 16, 2014

(86) PCT No.: PCT/IB2014/066959
§ 371 (c)(1),
(2) Date: Jun. 16, 2016

(87) PCT Pub. No.: WO2015/092675
PCT Pub. Date: Jun. 25, 2015

(65) Prior Publication Data

US 2016/0319703 A1 Nov. 3, 2016

(30) Foreign Application Priority Data

Dec. 19, 2013 (GB) ..... 1322604.8

(51) Int. Cl.
*F01K 11/02* (2006.01)
*F01K 5/02* (2006.01)
*F01D 25/10* (2006.01)

(52) U.S. Cl.
CPC ..... *F01K 11/02* (2013.01); *F01D 25/10* (2013.01); *F01K 5/02* (2013.01)

(58) Field of Classification Search
CPC . F01D 25/10; F01K 11/02; F01K 5/02; F01K 21/005
See application file for complete search history.

(56) References Cited

U.S. PATENT DOCUMENTS 2,902,830 A * 9/1959 Lenz ..... F01K 3/205 122/235.11
3,533,231 A * 10/1970 Lacy ..... F01K 21/005 122/40

(Continued)

FOREIGN PATENT DOCUMENTS

CN 102769304 A 11/2012
EP 12006 A2 6/1980

(Continued)

OTHER PUBLICATIONS

Terry Hendricks, et al., Power, Heating and Cooling using Thermal Exhaust Sources, Advanced Technology and Manufacturing Institute, Oregon State University, 2016, Oregon, US. http://mbi-online.org/power-heating-and-cooling-using-thermal-exhaust-sources.

(Continued)

*Primary Examiner* — Matthew T Largi
(74) *Attorney, Agent, or Firm* — Daniel Yeates

(57) ABSTRACT

A device for converting heat into mechanical energy is disclosed. The device includes a channel flow boiler having at least one channel adapted to heat a working fluid for generating a liquid-gas mixture; an expansion device adapted to expand the liquid-gas mixture; and a movable element arranged such that the expanding liquid-gas mixture at least partially converts an internal and/or kinetic energy of the liquid-gas mixture into mechanical energy associated with the movable element; wherein the channel flow boiler and/or the expansion device is adapted to supply heat to the liquid-gas mixture.

19 Claims, 9 Drawing Sheets

(56) References Cited

U.S. PATENT DOCUMENTS

| | | | | | |
|---|---|---|---|---|---|
| 4,227,373 | A * | 10/1980 | Amend | C02F 1/16 415/121.2 |
| 4,612,879 | A * | 9/1986 | Cooke | F22B 7/10 122/135.1 |
| 4,738,309 | A * | 4/1988 | Schilling | F28D 7/08 165/101 |
| 5,231,832 | A * | 8/1993 | Tarman | F01K 9/00 60/649 |
| 5,768,893 | A * | 6/1998 | Hoshino | F01D 25/10 60/682 |
| 2009/0260361 | A1 | 10/2009 | Prueitt | |
| 2010/0218496 | A1 | 9/2010 | Miles | |
| 2011/0061387 | A1 | 3/2011 | Held et al. | |
| 2012/0047889 | A1 | 3/2012 | Ulas Acikgoz et al. | |
| 2013/0014509 | A1 | 1/2013 | Perico et al. | |
| 2015/0219362 | A1* | 8/2015 | Barendregt | F24H 1/08 239/13 |

FOREIGN PATENT DOCUMENTS

| | | | | |
|---|---|---|---|---|
| GB | 498322 | A | 1/1939 | |
| GB | 2034412 | A * | 6/1980 | F01K 23/10 |
| GB | 1595509 | A | 8/1981 | |
| GB | 2069620 | A | 8/1981 | |
| GB | 2034412 | B | 11/1982 | |
| WO | 2010098491 | A2 | 9/2010 | |
| WO | 2013064858 | A1 | 5/2013 | |

OTHER PUBLICATIONS

Ali Tarique, Experimental Investigation of Scroll Based Organic Rankine Systems, Electronic Theses and Dissertations, Apr. 2011, University of Ontario Institute of Technology, Ontario, CA. https://ir.library.dc-uoit.ca/handle/10155/155.

Search Report under Section 17(5), IBM Reference No. CH920130074GB1, Application No. GB1322604.8, dated Aug. 19, 2014, 4 pages.

Written Opinion of the International Searching Authority & International Search Report, International Application No. PCT/IB2014/066959, IBM Ref. No. CH920130074PCT1, dated Apr. 28, 2015, 8 pages.

* cited by examiner

DEVICE AND METHOD FOR CONVERTING HEAT INTO MECHANICAL ENERGY

CROSS-REFERENCE TO RELATED APPLICATION

This applications claims priority under 35 U.S.C. § 371 from PCT Application No. PCT/IB2014/066959 filed on Dec. 16, 2014, which claims priority from United Kingdom Patent Application No. 1322604.8, filed on Dec. 19, 2013, the contents of which are incorporated herein by reference.

FIELD OF THE INVENTION

This disclosure relates to a device for converting heat into mechanical energy and a method for converting heat into mechanical energy. This disclosure relates further to an engine.

BACKGROUND

Most of today's electrical energy is generated by utilizing a thermodynamic cycle for creating mechanical work. The Carnot cycle is a theoretical thermodynamic cycle proposed by Nicolas Léonard Sadi Carnot. This theoretical cycle sets an upper limit for the efficiency of any thermodynamic cycle for converting a given amount of heat into work between two thermal reservoirs. The ideal cycle for two-phase working fluids is the Rankine cycle. William J. M. Rankine provided the fundamental thermodynamic underpinning of the steam engine that is considered the practical Carnot cycle for a two-phase working fluid because the T-s diagram resembles the Carnot cycle. The main difference is that heat addition (in the boiler) and rejection (in the condenser) are isobaric in the Rankine cycle and isothermal in the theoretical Carnot cycle. A pump pressurizes the working fluid received from the condenser. All of the energy in pumping the working fluid through the cycle is lost, as is all of the energy of vaporization in the boiler which is rejected in the condenser. Pumping the liquid working fluid requires about 1-3% of the turbine power, much less than compressing a gas. The efficiency of a Rankine cycle is limited by the working fluid and equipment materials. Steam entry temperatures into the turbine are ~565° C. and condenser temperatures are ~30° C. This gives a theoretical Carnot efficiency of ~63% and an actual efficiency of 42% for a modern power station. While many working fluids can be used, water is the fluid of choice since it is nontoxic, unreactive, abundant, low cost, and has good thermodynamic properties. When a Rankine cycle is implemented with organic working fluids, it is commonly referred to as on Organic Rankine cycle (ORC).

The classical Rankine engines have four discrete components: the boiler, the expander, the condenser and the pump and additionally involves a phase change between gas phase and liquid phase. In a classical Rankine cycle that runs at a maximal temperature given by the material properties of the expansion device, a part of losses is associated with the boiler due to conductive and convective exergetic losses and due to inherent losses associated with a pool boiling process. With the current trend to avoid exergetic losses of low grade heat and to collect low grade heat as part of solar technologies there is a growing demand for low temperature conversion engines. This area is sometimes covered by ORC engines because at lower pressures and temperatures the steam cycle requires too large expansion devices while organic fluids can maintain the same device size ratios as it was originally established for higher temperature steam Rankine cycles. Both steam and organic Rankine engines have low exergetic efficiencies compared to the upper limit given by the Carnot particularly at low temperatures.

SUMMARY OF THE INVENTION

According to an embodiment of a first aspect a device for converting heat into mechanical energy is disclosed, wherein the device includes a channel flow boiler having at least one channel adapted to heat a working fluid for generating a liquid-gas mixture, an expansion device adapted to expand the liquid-gas mixture, and a movable element arranged such that the expanding liquid-gas mixture at least partially converts the internal and/or kinetic energy of the liquid-gas mixture into mechanical energy associated with the movable element; wherein the channel boiler and/or the expansion device is adapted to supply heat to the liquid-gas mixture.

According to an embodiment of a second aspect a method for converting heat into mechanical energy is disclosed. The method includes heating a working fluid for generating a liquid-gas mixture; expanding the liquid-gas mixture, wherein a heat supplied to the liquid-gas mixture is at least partially converted into a kinetic energy of the liquid-gas mixture; and converting the internal and/or kinetic energy of the liquid-gas mixture into mechanical energy associated with the movable element, wherein the method is operated as a thermodynamic cycle such that the expansion of the liquid-gas mixture is approximately isothermal.

According to an embodiment of a third aspect an engine is disclosed. The engine includes a working fluid; a compression unit; a condensation unit; a channel flow boiler having at least one channel adapted to heat a working fluid for generating a liquid-gas mixture; an expansion device adapted to expand the liquid-gas mixture; and a movable element arranged such that the expanding liquid-gas mixture at least partially converts an internal and/or kinetic energy of the liquid-gas mixture into mechanical energy associated with the movable element; wherein the channel flow boiler and/or the expansion device is adapted to supply heat to the liquid-gas mixture.

BRIEF DESCRIPTION OF THE DRAWINGS

Like or functionally like elements in the drawings have been allotted the same reference characters, if not otherwise indicated.

DETAILED DESCRIPTION OF THE PREFERRED EMBODIMENTS

Figure 1:
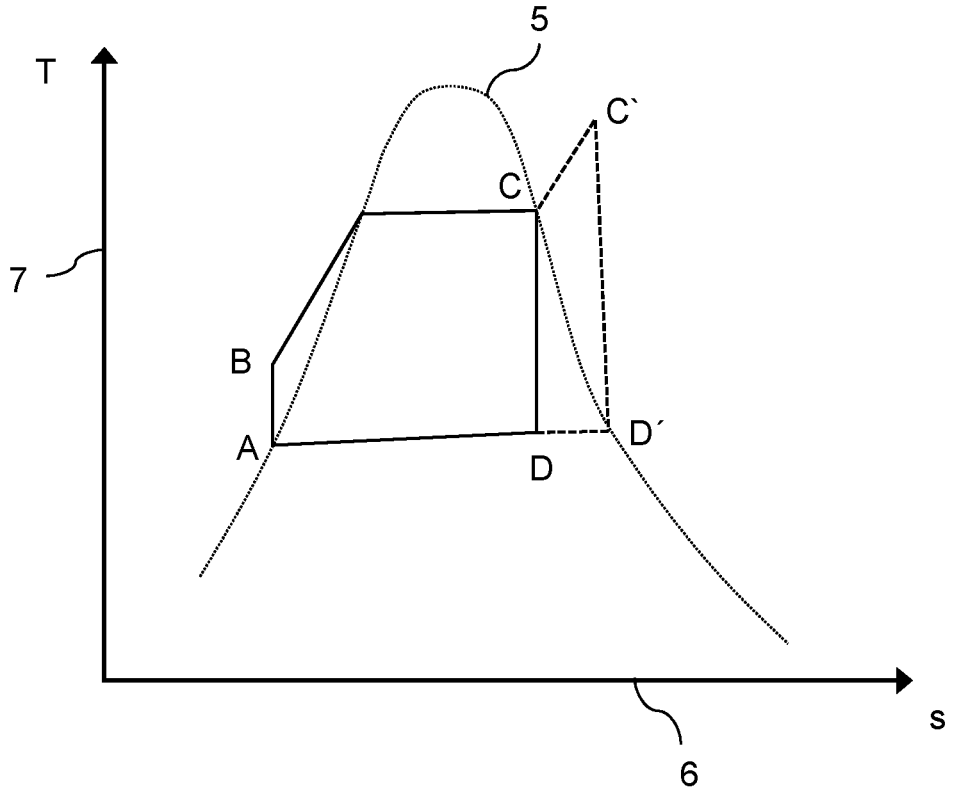
FIG. 1 shows a steam Rankine cycle in a T-s diagram.

It is therefore an aspect of the present disclosure to provide for an improved device for converting heat into mechanical energy.

It is another aspect of the present disclosure to provide an improved method for converting heat into mechanical energy.

It is yet another aspect of the present disclosure to provide an improved engine for converting heat into mechanical energy.

According to an embodiment of a first aspect a device for converting heat into mechanical energy is disclosed, wherein the device includes: a boiling device adapted to heat a working fluid for generating a liquid-gas mixture, an expansion device adapted to expand the liquid-gas mixture, and a movable element arranged such that the expanding liquid-gas mixture at least partially converts the internal and/or kinetic energy of the liquid-gas mixture into mechanical energy associated with the movable element. In particular, the expansion device cancan be further adapted to supply heat to the liquid-gas mixture.

The boiling device is preferably a channel flow boiler and includes at least one channel having a channel direction. According to a preferred embodiment the channel flow boiler is further adapted to accelerate the liquid-gas mixture along a channel direction. According to a preferred embodiment the channel direction of the channel flow boiler and a rotational axis of the movable element are essentially parallel to one another.

According to an embodiment the channel flow boiler is a micro-channel flow boiler and includes a plurality of linear micro-channels being arranged in parallel.

According to an embodiment of a second aspect a method for converting heat into mechanical energy is disclosed. The method includes: heating a working fluid for generating a liquid-gas mixture; expanding the liquid-gas mixture, wherein a heat supplied to the liquid-gas mixture is at least partially converted into a kinetic energy of the liquid-gas mixture; converting the internal and/or kinetic energy of the liquid-gas mixture into mechanical energy associated with the movable element; and the method can be operated as a thermodynamic cycle such that the expansion of the liquid-gas mixture is partially approximately isothermal.

According to an embodiment of a third aspect an engine is disclosed. The engine includes a working fluid, a compression unit, e.g. a pumping device, a condensation unit, and a device for converting heat into mechanical energy, wherein the engine is adapted to perform a thermodynamic cycle, and wherein the engine is adapted to perform a method for converting heat into mechanical energy. The device and the method can be implemented as depicted above.

The device and/or the engine can be operated according to the abovementioned method. E.g. the steps of heating and expanding can be performed by the boiling device and/or the expansion device. One can also contemplate a combined device adapted to heat and expand the working fluid for obtaining an accelerated liquid-gas mixture.

In particular, the disclosed device, method and engine cancan provide several advantages. When supplying heat to the liquid-gas mixture in the boiler and/or the expansion device, a partially approximately isothermal expansion of the liquid-gas mixture cancan be possible. This reheating can allow for higher overall volumetric expansion and, hence, conversion efficiencies from heat to mechanical work.

More particularly, the boiling device can be adapted to provide a liquid-gas mixture. A liquid-gas mixture can include a liquid phase of the working fluid and a gaseous phase of the working fluid. Further the boiling device can provide a liquid-gas mixture having a mass fraction of the gas or vapor of the liquid-gas mixture which is predetermined. The mass fraction of the gas of a liquid-gas mixture is also called vapor quality. Further, the boiling device can be adapted to accelerate the liquid-gas mixture along the channel direction. Further, the boiling device can be adapted to provide a liquid-gas mixture in which the liquid phase is finely dispersed into a plurality of droplets, these droplets being fully entrained in the flowing gas phase by virtue of their small size, so as to avoid undesirable erosion of the movable element, e.g. turbine blades, due to liquid droplet impingement.

The expansion device can include a turbine or a reciprocating device, such as a piston device. In particular, the expansion device can include an arrangement allowing for an expansion of the liquid-gas mixture. Due to the expansion of the liquid-gas mixture, a volume of the liquid-gas mixture will increase. In order to account for a volume increase of the expanding liquid-gas mixture, an inner volume of the expansion device can also increase, for example, along a flow direction.

Further, the boiling device can be a part of the expansion device such that the boiling device and the expansion device can form an at least partially combined device. In particular, the boiling device can be at least partially coupled to the expansion device. For example, an outlet of the boiling device and an inlet of the expansion device can coincide. In particular, the boiling device and the expansion device can be integrally formed. Further, the boiling device and the expansion device can be arranged or aligned such that a kinetic energy of the liquid-gas mixture generated in the boiling device can be maintained during a passage of the liquid-gas mixture from the boiling device to the expansion device. In particular, a conduit or a tube between the boiling device and the expansion device can be omitted.

The boiling device and the expansion device can each have a preferred direction, such as a flow direction of the working fluid. In embodiments, the preferred direction of the boiling device and the expansion device are parallel to one another and/or they are collinear.

Further, the movable element can be a piston or a rotor. In particular, the expanding liquid-gas mixture can move the movable element which can at least partially convert the internal and/or kinetic energy of the liquid-gas mixture into mechanical energy associated with the movable element. For example, the movable element can drive or propel a shaft for a generator such as an electrical generator.

According to an embodiment the channel direction of the channel flow boiler and a rotational axis of the movable element are essentially parallel to one another. Such an arrangement provides particular efficiency and reduces energy losses, e.g. due to a redirection of the working fluid.

In embodiments the channel direction of the channel flow boiler is arranged parallel to a rotational axis of the movable element. For example, the movable element is part of a turbine device having a rotational axis such as a turbine blade. In embodiments the channel direction and the rotational axis can be coaxially arranged.

The channel direction preferably faces towards an inlet of the expansion device.

Such an arrangement provides particular efficiency and reduces energy losses, e.g. due to a redirection of the working fluid.

Next, further embodiments of the device are explained. However, these embodiments also apply to the method and the engine.

According to an embodiment the boiling device is further adapted to accelerate the liquid-gas mixture. In particular, it can be easier to convert the kinetic energy associated with a directed velocity vector to shaft work compared to the case of less directed velocity vectors.

According to an embodiment the boiler and expansion devices are further adapted to supply heat to the liquid-gas mixture. According to an embodiment, the heat supplied to the liquid-gas mixture by the boiler and expansion devices at least partially compensates a temperature decrease of the liquid-gas mixture in the boiler and expansion devices.

The temperature of the liquid-gas mixture is decreased by the friction loss in the boiler device which reduces the pressure of the liquid-gas mixture and, therefore, the temperature of the liquid-gas mixture under saturation conditions. Further, the temperature of the liquid-gas mixture is decreased by the adiabatic expansion in the expansion device, by the partial evaporation of liquid and due to friction loss in the expansion device. The temperature drop can be compensated by the heat supplied in the boiler and expansion devices to achieve a near isothermal expansion. The amount of heat supplied to each respective device can be different to allow the compensation of different friction losses in each device. This can allow for a higher efficiency of heat to mechanical energy conversion.

According to a further embodiment, the expansion device includes a heat exchanger arrangement adapted to supply heat to the liquid-gas mixture.

The heat exchanger arrangement can include a conduit and a heat carrying fluid. In particular, the heat carrying fluid can be guided through the conduit. More particularly, the heat carrying fluid can exchange heat with its surroundings, for example with the liquid-gas mixture. In particular, the heat exchanger arrangement can be arranged in the expansion device such that the expanding liquid-gas mixture can flow along the heat exchanger arrangement. This can allow for an efficient heat transfer between the liquid-gas mixture and the heat exchanger arrangement. Further, the heat exchanger arrangement can include additional elements which increase the surface area of the heat exchanger arrangement. A larger surface area improves the heat transfer between the liquid-gas mixture and the heat exchanger arrangement. Furthermore, the heat exchanger arrangement can be adapted to allow for a maximized convective heat exchange with the liquid-gas mixture.

According to a further embodiment, the expansion device includes a turbine device including at least one movable rotor element adapted to at least partially convert the internal and/or kinetic energy of the liquid-gas mixture into mechanical energy. According to a further embodiment, the expansion device includes a multistage turbine device which further includes at least one heatable stator element adapted to supply heat to the liquid-gas mixture.

In particular, the expanding liquid-gas mixture can propel the movable rotor element of the turbine device. The internal and/or kinetic energy of the expanding liquid-gas mixture can cause the movable rotor element to rotate. Due to a rotation of the rotor element, the internal and/or kinetic energy of the liquid-gas mixture can be converted into a mechanical energy. In order to achieve an almost isothermal expansion in the turbine device, heat can be provided to the expanding liquid-gas mixture. This can be achieved by supplying heat to the liquid-gas mixture using the heatable stator element. The heatable stator element can be a part of the turbine device which is stationary with respect to the movable rotor element. Since the stator element is stationary, providing heat via the stator element can be easier. However, heat can also be supplied to the liquid-gas mixture via the rotor element. Depending on the required amount of heat, only the stator element or the rotor element can be heated or both of the rotor element and the stator element can be heated.

According to a further embodiment, the turbine device includes a plurality of subsequent stages, wherein each stage has a movable rotor element adapted to at least partially convert the internal and/or kinetic energy of the liquid-gas mixture into mechanical energy and a heatable stator and/or rotor element adapted to supply the heat to the liquid-gas mixture.

In particular, a turbine device including a plurality of subsequent stages can provide the advantage that a maximum of the internal and kinetic energy stored in the liquid-gas mixture can be converted into mechanical energy. This can be achieved by subsequently converting internal and/or kinetic energy of the liquid-gas mixture into mechanical energy using a rotor element and contemporaneously supplying heat to the liquid-gas mixture. The supplied heat can then cause a fraction of the liquid phase of the liquid-gas mixture to evaporate which again converts heat into internal energy. This process is preferably repeated until all liquid is evaporated. At this stage a final adiabatic expansion is performed to cool down the vapor prior to the entry into the condenser with one or several rotor stages with no heat transfer in the stator.

According to a further embodiment, at least one heatable stator element is arranged downstream of the moveable rotor element with respect to a flow direction of the liquid-gas mixture.

Arranging the heatable stator element downstream of the movable rotor element with respect to a flow direction of the liquid-gas mixture can have the advantage that the heat supplied to the liquid-gas mixture by the heatable stator element can at least partially compensate the internal and/or kinetic energy transferred to the movable rotor element.

According to a further embodiment, the heatable stator element includes a plurality of fins adapted to exchange heat with the liquid-gas mixture.

An advantage of the plurality of fins can be that a surface area of the stator element is increased. An increased surface area can improve a heat supply to the liquid-gas mixture. In particular, the plurality of fins can be arranged parallel to a flow vector of the liquid-gas mixture. Further, the fins can be spaced from one another, wherein a spacing between the fins and the length of the fins in the flow direction of the gas is selected such that a heat exchange between the plurality of fins and the liquid-gas mixture is optimized while a flow resistance caused by the plurality of fins is kept as low as possible.

According to a further embodiment, the boiling device includes a channel flow boiler including at least one channel and at least one heating element arranged adjacent to the at least one channel, wherein the working fluid is guided through the at least one channel and simultaneously heated by the heating element for generating the liquid-gas mixture by increasing the internal and/or kinetic energy of the working fluid. According to a further embodiment, the boiling device is further adapted to accelerate the liquid-gas mixture.

In particular, the channel flow boiler can be a micro channel flow boiler including a micro channel. A micro channel can be a channel having a cross section perpendicular to a length of the channel in a sub-millimeter range. The channel can also be a mini channel flow boiler including a mini channel. A mini channel can be a channel having a cross section perpendicular to a length of the channel in the range of one to five millimeters. Further, the heating element can be a heat exchanger arrangement and/or an electrical heating element. The channel flow boiler can allow for a convective heat transfer between the heating element and the working fluid in the channel flow boiler. Furthermore, the micro or mini channel flow boiler can be adapted to accelerate the liquid-gas mixture. In particular, due to the acceleration of the liquid-gas mixture kinetic energy can be created which additionally improves a subsequent energy conversion.

By heating the working fluid in the channel flow boiler, an expansion and evaporation of the working fluid generates a liquid-gas mixture. The boiling of the working fluid in the channel flow boiler accelerates the liquid-gas mixture. Moreover, the channel flow boiler generates a liquid-gas mixture including a gaseous phase and a liquid phase at an outlet, wherein the liquid phase includes small droplets embedded in a flow of the gaseous phase. Furthermore, boiling the working fluid in a channel flow boiler provides the advantage that a dissipative part of the boiling is minimized. A dissipative part that can occur in the channel flow boiler is friction at a wall of the channel. In particular, the friction induced energy loss in the channel of the channel flow boiler can be proportional to the squared speed of the working fluid and an inverse $4^{th}$ power of the channel diameter. In the channel cavitation can occur such that gas or vapor bubbles or cavities arise in the liquid. Generally, the liquid phase can remain attached to the walls of the channel, while the cavities flow in an embedded fashion. When exiting from the channel at an outlet nozzle a liquid gas mixture including very small liquid droplets and gaseous working fluid can occur.

The channel flow boiler can be made of a semiconductor material, such as silicon. Alternatively, the channel flow boiler can be made of metal, for example copper. In particular, the channel can be manufactured employing suitable etching, casting, additive manufacturing techniques and/or cutting techniques, e.g. skiving. Further, the channel flow boiler can be made out of a composite material including a polymeric material and a reinforcing phase which improves the thermal conductivity of the composite material. For example, the reinforcing phase can include elongated fibers made of carbon or carbides, while the polymeric material can be made of an epoxy resin. Other materials can be contemplated.

According to a further embodiment, the at least one channel of the channel flow boiler includes a first part having a first cross section in a direction perpendicular to a flow direction of the working fluid and a second part having a second cross section in a direction perpendicular to a flow direction, wherein the first cross section is smaller than the second cross section. More particularly, the different cross sections of the first and the second channel part, particular the different sizes, can allow for generating a directed acceleration of the liquid-gas mixture.

According to a further embodiment, the first cross section increases along the first part and wherein the second cross section is constant. The increasing first cross section can particularly facilitate the cavitation. In particular, due to the increasing first cross section, a back flow of the accelerated liquid-gas mixture can be prevented. Further, the increasing cross section of the first channel part controls the directed acceleration of the liquid-gas mixture so that the kinetic energy content of the fluid gas mixture is maximized while the losses through friction are minimized. Furthermore, the cross section of the first part and the second part can provide the advantage that a speed and/or acceleration of the liquid-gas mixture can be tunable.

According to a further embodiment, the channel flow boiler includes a plurality of channels arranged parallel to another and a plurality of heating elements arranged adjacent to the plurality of parallel channels, wherein the working fluid is guided through the plurality of channels and simultaneously heated by the plurality of heating elements for generating and accelerating the liquid-gas mixture. In particular, the plurality of channels can be arranged in such a way that the plurality of channels can create a homogenous flow field of the liquid-gas mixture. In embodiments at least a group of the channels have different cross sections.

According to a further embodiment, the boiling device includes a closing element adapted to close off a group of the plurality of channels of the channel flow boiler for tuning the amount of the liquid-gas mixture generated and accelerated in the boiling device.

In particular, the closing element can provide the advantage that the flow of the liquid-gas mixture can be adjustable. For example, it can be advantageous to reduce an amount of the liquid-gas mixture by closing off a group of the plurality of channels instead of reducing the amount of liquid-gas mixture and therefore linearly the speed and quadratically the kinetic energy of the liquid-gas mixture in an individual channel.

According to a further embodiment, the step of heating a working fluid for generating a liquid-gas mixture further includes accelerating the liquid-gas mixture.

According to a further embodiment, the step of converting the internal and/or kinetic energy of the liquid-gas mixture into mechanical energy associated with the movable element further includes supplying heat to the liquid-gas mixture.

According to a further embodiment, the method further includes compensating at least partially a temperature decrease of the expanding liquid-gas mixture by supplying heat to the liquid-gas mixture.

According to an embodiment, the method includes repeating the sequence of steps a) expanding the liquid-gas mixture;
b) compensating at least partially a temperature decrease of the expanding liquid-gas mixture by supplying heat to the liquid-gas mixture; and
c) converting the internal and/or kinetic energy of the liquid-gas mixture into mechanical energy. In particular, repeating the sequence of steps can allow for an approximately isothermal expansion of the liquid-gas mixture.

According to an embodiment, the engine further includes a heat source for supplying the heat to the liquid-gas mixture in the expansion device and/or for supplying the heat to the working fluid the boiling device. In particular, the heat source can be thermal energy collected by solar collectors or waste heat such as industrial waste heat, power generation waste heat, etc.

In embodiments of the devices or the method the vapor quality of the liquid gas mixture at the outlet of the channel flow boiler is between 10% and 90%. The vapor quality can be defined as mass fraction of steam/vapor. According to a particularly preferred embodiment the vapor quality of the liquid gas mixture at the outlet of the channel flow boiler is between 30% and 80%.

According to an embodiment the liquid-gas mixture between the outlet of the boiling device/channel flow boiler and the inlet of the expansion device includes between 10% and 90% mass fraction of liquid. According to a particularly preferred embodiment the liquid-gas mixture between the outlet of the boiling device/channel flow boiler and the inlet of the expansion device includes between 20% and 70% mass fraction of liquid.

Investigations of the applicant have shown that the above mentioned ranges according to preferred embodiments can provide on the one hand sufficient kinetic energy and on the other hand avoid too much friction.

According to a further embodiment the liquid-gas mixture between the outlet of the boiling device/channel flow boiler and the inlet of the expansion device includes between 0.001% and 1% of liquid per volume, wherein the liquid is preferably dispersed as/in the form of droplets.

In case of steam as working fluid the liquid-gas mixture between the outlet of the boiling device/channel flow boiler and an inlet of the expansion device includes according to a preferred embodiment between 0.002% and 0.040% of liquid per volume, wherein the liquid is preferably dispersed in the form of droplets.

According to an embodiment, the sizes of droplets (in particular the diameters), in terms of liquid particles in the liquid-gas mixture are, for example, between 0.0001 mm and 1 mm, and preferably between 0.001 mm and 0.1 mm.

Investigations of the applicant have shown that the above mentioned ranges according to preferred embodiments can provide on the one hand sufficient kinetic energy and on the other hand avoid too much friction.

However, one can contemplate other values for the droplet sizes, mass fractions or vapor qualities.

Certain embodiments of the presented device for converting heat into mechanical energy, the method for converting heat into mechanical energy, and the engine can include individual or combined features, method steps or aspects as mentioned above or below with respect to embodiments. In general, where features are described herein with reference to an embodiment of one aspect of the invention, corresponding features can be provided in embodiments of another aspect of the invention.

In the following, embodiments of the device and the method are described with reference to the enclosed drawings.

The term "working fluid" refers to a fluid utilized in a thermodynamic cycle. During the thermodynamic cycle, the working fluid can be pressurized, expanded, condensed and/or compressed. Further, the working fluid can undergo a phase change, particularly between a liquid phase and a gaseous phase and vice versa. For example, the working fluid can be water. However, the working fluid can also be an organic fluid such as methanol, toluene, or pentane.

It is understood that a "channel" includes an elongated structure allowing a fluid to flow along its longitudinal extension. A channel has usually a transverse dimension or width defined through its cross section and a longitudinal dimension or length. The length is considered larger than the width. A channel can be, for example, a conduit, tube, guide, or the like. Some channels have a straight longitudinal extension and are not curved. The "channel direction" essentially follows the longitudinal extension of a channel. One can also refer to a channel axis.

It is understood that, in the following, only sections or parts of a device for converting heat into mechanical energy are shown. In actual embodiments additional elements such as valves, tubes, conduits, accessories, fittings, pumps, compressors, and the like can be included.

The embodiments show some similarity with a Rankine cycle-based process. FIG. 1 shows a steam Rankine cycle in a T-s diagram. In particular, the steam Rankine cycle is commonly used in steam generators generating electrical energy. The abscissa 6 represents an entropy s of the system and the ordinate 7 represents the absolute temperature T of the system. A curve 5 represents the saturation vapor curve of an employed working fluid, for example steam. The Rankine cycle includes an adiabatic compression of the working fluid (A→B), an isobaric heat addition to the working fluid (B→C), an adiabatic expansion of the working fluid (C→D), and an isobaric heat release (D→A). The efficiency of the Rankine cycle is limited to ~70% of the efficiency of the Carnot cycle. The main differences between the Rankine cycle and the theoretical Carnot cycle are that the heat addition (e.g. in the boiler) and the heat release (e.g. in the condenser) are isobaric (i.e. a pressure is constant) instead of isentropic and that the expansion of the working fluid is adiabatic instead of isothermal. Also, a practical problem encountered for conventional implementation of the Rankine cycle is the formation of water droplets during the adiabatic expansion of the working fluid (C→D). These water droplets result in impingement erosion of the turbine blades. For this reason, the vapor is for example superheated which results in a loss of cycle efficiency. The Rankine cycle with superheat is indicated in FIG. 1 by the process A-B-C-C'-D'-A.

Figure 2:
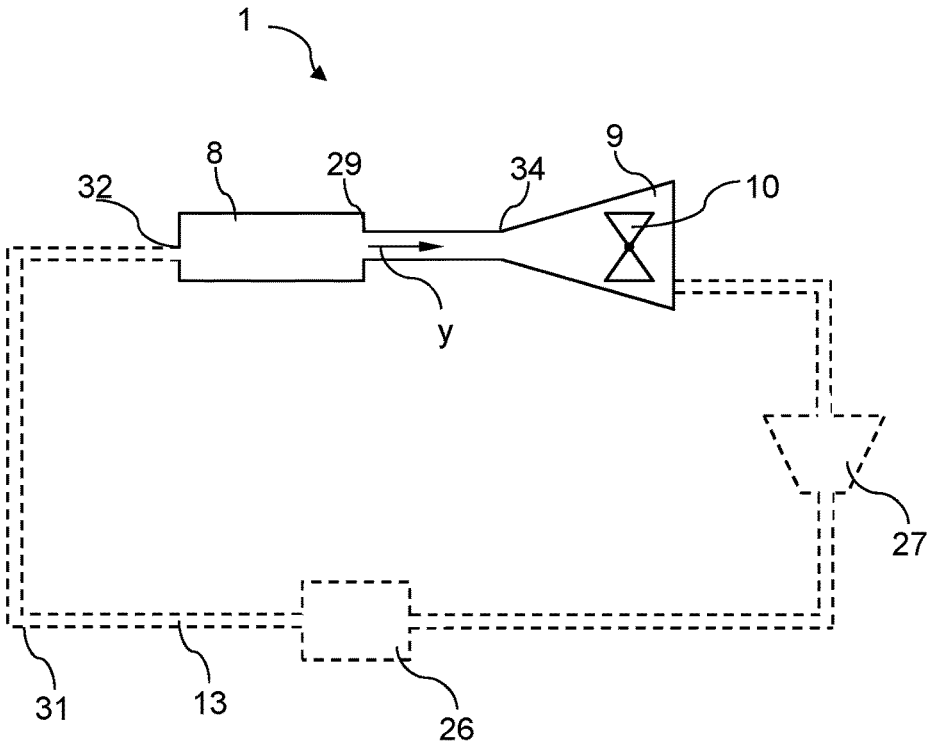
FIG. 2 shows a schematic diagram of an embodiment of a device for converting heat into mechanical energy according to an embodiment.

FIG. 2 shows a schematic diagram of an embodiment of a device 1 for converting heat into mechanical energy. The device 1 includes a boiling device that is implemented as a channel flow boiler 8 adapted to heat a working fluid 13 for generating and accelerating a liquid-gas mixture from a liquid working fluid 13. The channel flow boiler 8 has at least one channel defining a channel direction y. The working fluid 13 is supplied to the boiling device 8 via an inlet 32 from a supply line 31. An outlet 29 of the boiling device 8 is connected to an inlet 34 of an expansion device 9. The channel direction y can coincide with a preferred direction of a movable element 10 in the expansion device 9. The expansion device 9 is adapted to expand the liquid-gas mixture and adapted to supply heat to the liquid-gas mixture. In particular, the expansion device 9 at least partially converts internal and/or kinetic energy into mechanical energy by a movable element 10. In order to employ the device 1 in an engine arrangement utilizing a thermodynamical cycle, the device 1 can optionally be connected to a condenser 27 and a pump 26. The preferred direction can be a rotational axis of the movable element.

The boiling device 8 and the expansion device 9 have a comparable size. Hence, a separation of these functions heating and expanding in individual entities is not necessary. The boiling device 8 and the expansion device 9 can be one integrated device. In conventional steam engines boilers and condensers (heat exchange devices) have much larger volumes than expansion devices for the current temperatures and pressures established. The disclosed devices and methods allow for smaller and better integrate systems and arrangements for converting heat into mechanical energy.

In particular, the boiling device 8 can be a heat exchange component usually employed in computer industry having about 10-100× smaller volumes and about 10-100× higher power densities compared to standard heat exchange components. These heat exchange components can preferably use flow boiling processes instead of pool boiling processes that reduce energy losses and temperature gradients. This technology can particularly support a combination or unification of a boiling device with an expansion device. In particular, combining the boiling device and the expansion device can enable an improved thermodynamic cycle implementation in particular for low grade heat conversion using steam as well as other two phase working fluids. For example, a boiling device having a channel array can preferably result in a smaller temperature gradient for the boiling process and more directed velocity vector of a preferably accelerated gas phase compared to a conventional boiler. In this case, a volumetric change can be exploited better in the sense that it can be easier to convert the kinetic energy associated with a directed velocity vector to shaft work compared to the case of less directed velocity vectors. Furthermore, a second effect of growing expansion devices can be that they become preferably volumetrically comparable to the boiling device, i.e. they can have the same sizes. This can allow removing the separation of these devices and combining them in one device with the objective of improving the overall efficiency.

Figure 3:
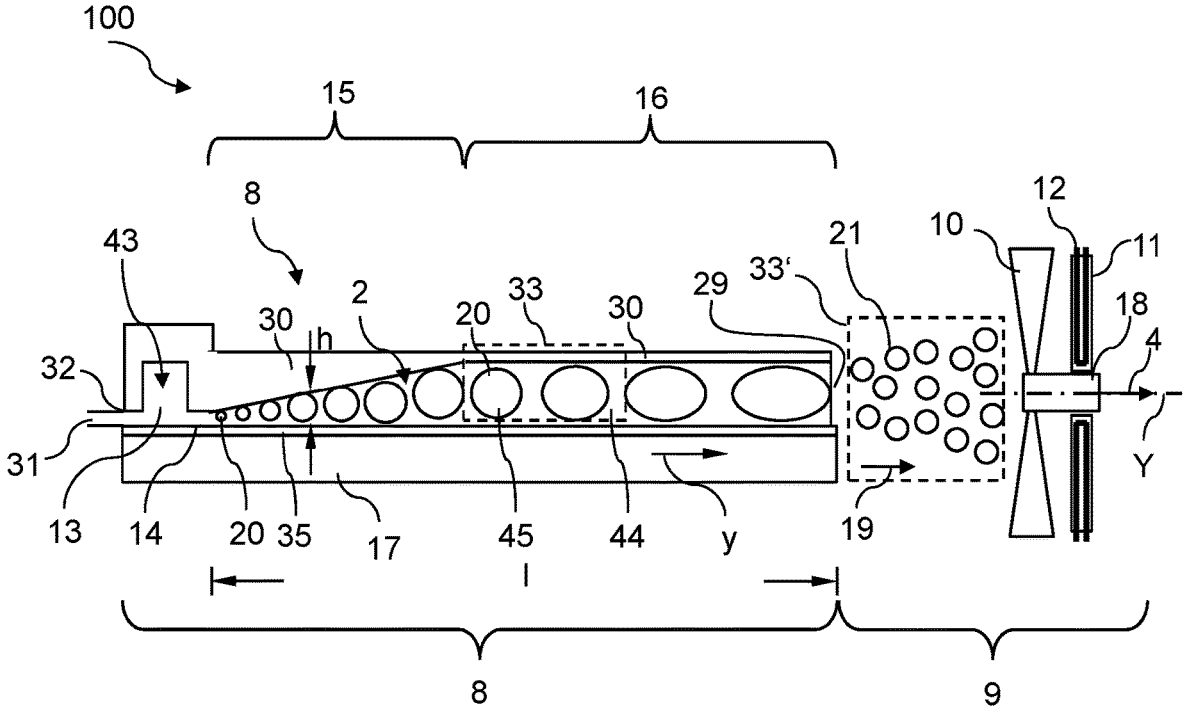
FIG. 3 shows a schematic cross section view of a further embodiment of a device for converting heat into mechanical energy according to an embodiment.

FIG. 3 shows a schematic cross section view of a further embodiment of a device 100 for converting heat into mechanical energy. The device 100 shown in FIG. 3 includes a boiling device 8 having a channel 2 and a heating element 17 arranged adjacent to the channel 2. The heating element 17 can for example be a conduit with a heat carrying fluid. In particular, the boiling device 8 is a channel flow boiler, for example a micro channel flow boiler. The channel direction is indicated as y. A supply line 31 supplies the liquid working fluid 13 via an inlet 32 to the channel flow boiler 8. In particular, the supplied working fluid 13 can be pressurized. The working fluid 13 is introduced into the channel 2 of the channel flow boiler 8 via a nozzle 14 that can act as a throttle for the liquid working fluid.

At the nozzle 14 a pressure difference between the channel 2 at a first side of the nozzle 14 and a supply line 31 of the pressurized working fluid 13 on a second side occurs, wherein the pressure on the channel side of the nozzle 14 can be lower than on a supply side of the nozzle 14. In particular, the inlet 32 can be connected to a common distribution chamber 43 which is adapted to distribute the working fluid 13 to further boiling devices (not shown). 43 can be a manifold. When the working fluid 13 enters the channel 2 via the nozzle the working fluid 13 experiences a pressure drop. The pressure drop can create small cavities 20 of a gaseous phase of the working fluid 13. A boiling process is initiated by cavitation thereby eliminating boiling superheat. The nozzle 14 can have a size in the range between 1 μm×1 μm and 1 mm×1 mm, preferably between 50 μm×50 μm and 500 μm×500 μm. The nozzle can have a spherical cross-section, a semi-spherical cross section or a rectangular cross section. Further cross-sectional geometries can be conceived which are also functional but can be more difficult to manufacture.

The channel 2 can be formed by an etching technique in a semiconductor material. Further, the channel is formed between a bottom wall 35 thermally coupled to the heating element 17 and an upper wall 30. The channel 2 includes a first part 15 having a first cross section in a direction perpendicular to a flow direction 19 of the working fluid and a second part 16 having a second cross section in a direction perpendicular to the flow direction 19 of the working fluid 13. In particular, the first cross section increases along the first part 15 from a size corresponding to the size of the nozzle 14 to a size corresponding to the second cross section. FIG. 3 shows that the first part 15 of the channel increases linearly. However, the cross section can alternatively increase less or more than linear. Further, the increasing cross section can be achieved by increasing both a height h of the channel and a width of the channel, wherein the width of the channel is perpendicular to the height h and a length l of the channel 2. However, the increasing cross section can alternatively be achieved by increasing only the height h of the channel 2 while maintaining the depth d of the channel 2. In particular, the end size of the first cross section can be between 5 and 20 times larger than the start size of the first cross section. Further, the second cross section is constant along the second part 16 of the channel 2. Moreover, the channel 2 can have a length in the range between 0.1 mm and 100 mm. Further, a length of the first part 15 of the channel 2 can be equal to a length of the second part 16 of the channel 2. The second part 16 of the channel 2 can be between 0.25 times and 5 times longer than the first part 15 of the channel 2.

Due to the heat transferred to the working fluid in the boiling device 8, the working fluid expands and evaporates and at least a fraction of the liquid working fluid 13 is transferred into a gaseous phase of the working fluid 13. The gas or vapor content is indicated as cavity 20. An advantage of the channel flow boiler 8 shown in FIG. 3 is that the channel 2 allows for a good convective heat transfer between the working fluid 13 and the boiling device 8. In particular, the nozzle 14 triggers the boiling process due to a pressure drop which creates small cavities 20 formed by the gaseous phase of the working fluid 13. Thus, the liquid working fluid 13 is transferred into a working fluid including two phases, a liquid phase 44 and a gaseous phase 45. This is illustrated in terms of a volume 33 of the working fluid 13 including a liquid phase fluid 44 and cavities 20 containing gas or vapor phase fluid 45. Due to the evaporation process, the fraction of the gaseous phase increases and the cavities created by the pressure drop in the nozzle expand.

The gas cavities 20 are reflected or repelled from the walls 30, 35 of the channel 2. In particular, the increasing cross section in the first part 15 of the channel 2 facilitates a directional acceleration of the liquid-gas mixture towards the outlet 29 of the boiling device 8. Thus, a backward flow of the working fluid 13 towards the supply line 31 can be preventable. Depending on the nozzle, a fraction of an available exergy, i.e. a usable work generated by a system, can be frictionally dissipated but the majority is converted into internal and/or kinetic energy of the moving working fluid.

The liquid-gas mixture 33 is guided through the channel 2 towards the outlet 29 of the boiling device 8. During the passage of the liquid-gas mixture 33 through the channel 2, the size of the cavities 20 containing the gaseous phase 45 of the working fluid 13 can increase. At the same time, the cavities 20 are guided along the channel 2. At the outlet 29 of the boiling device 8, the liquid-gas mixture 33 exits the boiling device 8 essentially parallel to the channel direction y. In particular, the cavities 20 containing the gaseous phase 45 of the liquid-gas mixture 33 expand and disrupt upon exiting the channel 2, thus forming droplets 21 containing the liquid phase 44 of the liquid-gas mixture 33. This is illustrated in terms of a volume 33' of the working fluid 13 showing the droplets 21. In other words, while the liquid-gas mixture 33 includes cavities 20 containing the gaseous phase 45 during its passage through the channel 2 of the boiling device 8, the liquid-gas mixture 33' includes droplets 21 containing the liquid phase 44 after exiting the boiling device 8.

For example, in case that the working fluid 13 is water vapor, which has a relatively large volume at a pressure of 1700 mbar, a 30 kg/s flow of a 10 MW power station can be expanded 1600 fold to 43 $m^3$/s upon full evaporation of the working fluid 13. This can accelerate the water vapor to supersonic speed. The resulting speed of the liquid-gas mixture can be adapted be using a larger cross section in the second part 16 of the channel 2, by selecting a lower vapor quality and the number of microchannels. For example, investigations of the applicant show that by using a cross section in the second part 16 which is 5× larger than the nozzle, such as a nozzle having a cross section of 1 $mm^2$ and 15'000 channels having second cross section of 6.25 $mm^2$, and a vapor quality of 58%, the resulting speed of the liquid-gas mixture is 330 m/s. This results in a kinetic energy fraction up to 15% of the mechanical energy conversion.

In embodiments the nozzle has a cross section between 0.1 and 10 $mm^2$, preferably between 0.2 and 5 $mm^2$, and even more preferable between 0.5 and 2 $mm^2$. In embodiments the number of channels is between 1000 and 100000, preferably between 2000 and 50000, and even more preferable between 5000 and 25000. In embodiments the channels have a cross section between 1 and 100 $mm^2$, preferably between 2 and 50 $mm^2$, and even more preferable between 3 and 20 $mm^2$. In embodiments the vapor quality is between 30 and 90%, preferably between 40 and 80%, and even more preferable between 50 and 70%. In embodiments the speed of the liquid-gas mixture is between 50 and 600 m/s, preferably between 150 and 500 m/s, and even more preferable between 250 and 400 m/s.

In particular, the final speed of the liquid-gas mixture at the outlet 29 of the channel flow boiler 8 is selected so that the kinetic energy $m*v^2/2$, wherein m is the mass liquid-gas mixture and v is the velocity of the liquid-gas mixture contains at least a part of the losses of a non-accelerating boiler. Furthermore, depending on the boiling device 8, the channel 2 can lose its relatively good convective heat transfer above a certain vapor quality. However, above a certain vapor quality, the two-phase flow can reach dry-out conditions and loss of the liquid film on the channel walls. The result is a drastic loss in heat transfer coefficient. In particular, the frictional energy loss in the channel 2 of the channel flow boiler 8 can be proportional to a squared speed of the working fluid and an inverse $4^{th}$ power of a channel diameter. Additionally, if the velocity of the liquid-gas mixture is too high, friction in the channel can increase. If the velocity of the liquid-gas mixture 33' is too high, the impact energy of the droplets 21 containing the liquid phase 44 of the liquid-gas mixture 33' onto the movable element 10 can be too large and the transfer into kinetic energy of the movable element can be destroyed due to droplet impact. A high gas flow speed can be needed at the exit of the nozzles to create a "spray" with the remaining drop sizes in the micrometer/nanometer regime.

The device 100 further includes an expansion device 9 adapted to expand the liquid-gas mixture 33' and adapted to supply heat to the liquid-gas mixture 33'. In particular, the expansion device can be a turbine 9 and is attached to the boiling device 8. This internal and/or kinetic energy of the liquid-gas mixture is at least partially converted into mechanical energy, which is indicated by the arrow 4, by a movable rotor element 10. The movable rotor element 10 is for example a blade mounted on a shaft 18 of the turbine 9. The shaft 18 has a rotational axis Y that is in parallel to the channel direction y. In particular, the movable rotor element 10 is adapted to rotate around the shaft 18 of the turbine 9. In order to facilitate this rotation, the rotor element 10 can include a suitable structure or shape.

In the embodiment the working fluid exiting the channel flow boiler 8 is directly accelerated towards the expansion device 9 including the rotor element 10. The channel direction or axis y points towards the face(s) of the rotor elements or blades 10. There is essentially no direction change of the working fluid between the boiling device 8 and the expansion device 9. This arrangement can reduce a loss.

The axis y of the channel 2 and the axis Y of the turbine can be co-linear. However, one can also contemplate embodiments where the axes y, Y are arranged in parallel to one another but are spaced with respect to each other.

Furthermore, the turbine 9 can include a heatable stator element 11 adapted to supply heat to the liquid-gas mixture 33' in expansion. In order to supply the heat to the liquid-gas mixture the heatable stator element 11 includes a heat exchanger arrangement 12. The heat exchanger arrangement 12 includes a conduit through which a heat carrying fluid is guided. In particular, the heat supplied to the liquid-gas mixture by the heatable stator element 11 at least partially compensates a temperature decrease of the liquid-gas mixture in the expansion device 9.

An advantage of the boiling device 8 and the expansion device 9 can particularly be that the liquid-gas mixture 33' is directly transferred from the boiling device 8 into the expansion device 9. An additional advantage of the boiling device 8 is a minimized temperature drop between the heat source and working fluid. This can increase exergy efficiency. One can contemplate an integrated device including a micro channel boiler and turbine. Thus, the kinetic energy of the liquid-gas mixture is transferred and utilized in the expansion device 9. Due to the small size of the channel flow boiler 8, the channel flow boiler 8 is compatible in terms of volume with the turbine 9. This can prevent a loss of kinetic energy of the flowing working fluid due to frictional dissipation arising from an impact upon potential tube or conduit walls.

Figure 4:
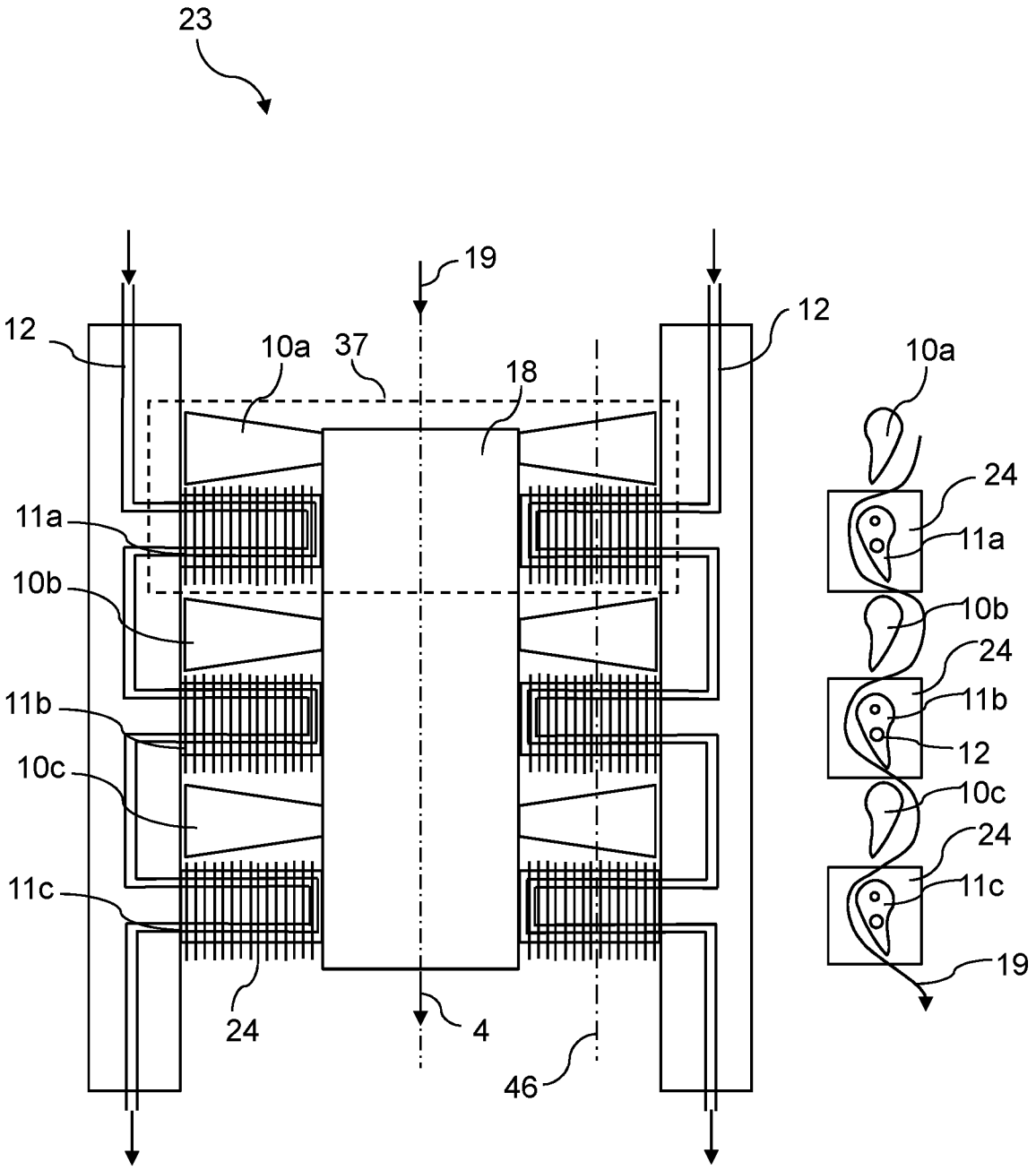
FIG. 4 shows a schematic cross section view of an expansion device and movable element according to an embodiment.

FIG. 4 shows a schematic view of a turbine 23 for an expansion device according to an embodiment. The turbine 23 includes a shaft 18 and a plurality of subsequent stages. Each stage includes a movable rotor element 10*a*, 10*b*, 10*c* and a heatable stator element 11*a*, 11*b*, 11*c*. A dashed line indicates the first stage 37 of the turbine 23, which includes the rotor element 10*a* and the stator element 11*a*. Each rotor element 10*a*, 10*b*, 10*c* is adapted to at least partially convert the internal and/or kinetic energy of the liquid-gas mixture into mechanical energy 4. On the right, a cross sectional view along the plane 46 is shown. The curved 19 indicates a flow of the liquid-gas mixture. Each stage of the turbine 23 further includes a heatable stator element 11*a*, 11*b*, 11*c* adapted to supply the heat to the liquid-gas mixture. In the turbine 23, each stator element 11*a*, 11*b*, 11*c* is arranged downstream of the respective moveable rotor element 10*a*, 10*b*, 10*c* with respect to the flow 19 of the liquid-gas mixture. For an improved heat exchange, each stator element 11*a*, 11*b*, 11*c* includes a heat exchanger arrangement 12 including a conduit through which a heat carrying fluid is guided. Each stator element 11*a*, 11*b*, 11*c* includes a plurality of fins 24 adapted to exchange heat with the liquid-gas mixtures.

Due to the approximately isothermal expansion achieved in the multistage turbine 23 according to the embodiment, the Rankine limit of the efficiency can be approached.

Another advantage of the disclosed embodiments can be that due to the liquid-gas mixture, which is introduced at the inlet 34 into the expansion device 9 (FIG. 2), an evaporation process of the working fluid can continue. Thus, a transfer from internal energy of the working fluid into a mechanical energy can be more exploited. The turbine 23 of the expansion device (FIG. 4) is adapted to function with a fluid containing liquid droplets 21. In a low pressure regime, as it is the case in the embodiments of the present device and method, the impact energies are relatively low. Also, the liquid droplets are entrained in the vapor flow due to their small size, which provides favorable velocity vectors near the turbine blades, resulting in lower impact energy. Due to the liquid droplet entrainment, no superheating of the steam is required, as shown for example by the process A-B-C'-D'-A in FIG. 1, resulting in improved efficiency of conversion of heat to work for the present invention compared to the state-of-the-art.

Figure 5:
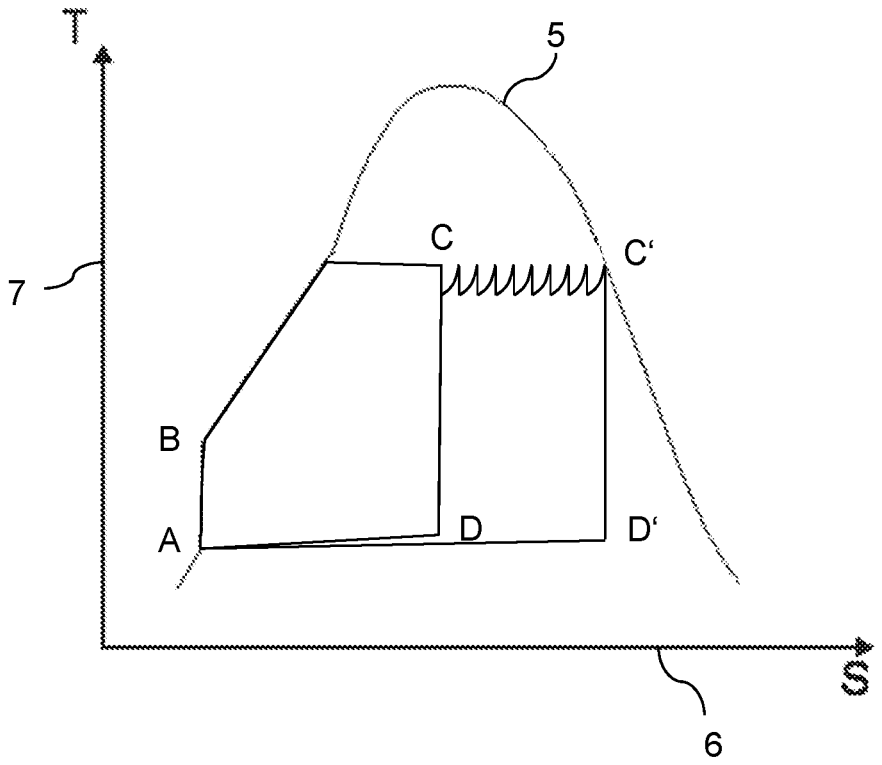
FIG. 5 shows a modified thermodynamic cycle according to an embodiment in a T-s diagram.

FIG. 5 shows a modified thermodynamic cycle according to an embodiment of an operation method for the device for converting heat into mechanical energy including the arrangement of FIG. 3 in a T-S diagram. The abscissa 6 represents the entropy s of the system, and the ordinate 7 represents the absolute temperature T of the system. A curve 5 represents the saturation vapor curve of an employed working fluid, for example steam. The modified thermodynamic cycle includes an adiabatic compression of the working fluid (A→B), a heat addition to the working fluid (B→C) in the channel flow boiler 8 followed by an approximately isothermal expansion (C→C') in the turbine 23. The tooth structure shown between the points C and C' represents a series of expansions of the working fluid, wherein each expansion is combined with a reheating of the working fluid. Due to the adiabatic expansion of the working fluid and a further evaporation of a fraction of the liquid phase of the liquid-gas mixture in the turbine 23, the temperature decreases which is apparent from the vertical sections of the curve between C and C'. The decrease in temperature is subsequently compensated by a supply of heat in each stator element of the turbine 23. This is illustrated by the rising sections following the vertical ones. After the remaining liquid phase in the liquid-gas mixture is evaporated, the working fluid undergoes a final adiabatic expansion (C'→D') for example in a final stage of the turbine 23. The thermodynamic cycle shown in FIG. 4 is completed by an isobaric heat release (D'→A), for example, in a condenser.

The method and devices disclosed are preferably implemented such that an expansion of the working fluid or liquid-gas mixture occurs approximately isothermal. It is understood that, referring to FIG. 5 the process section between C and C' occurs in a limited temperature range defined by the teeth of the curve. The height or amplitude of the teeth is within the temperature range considered approximately isothermal.

Figure 6:
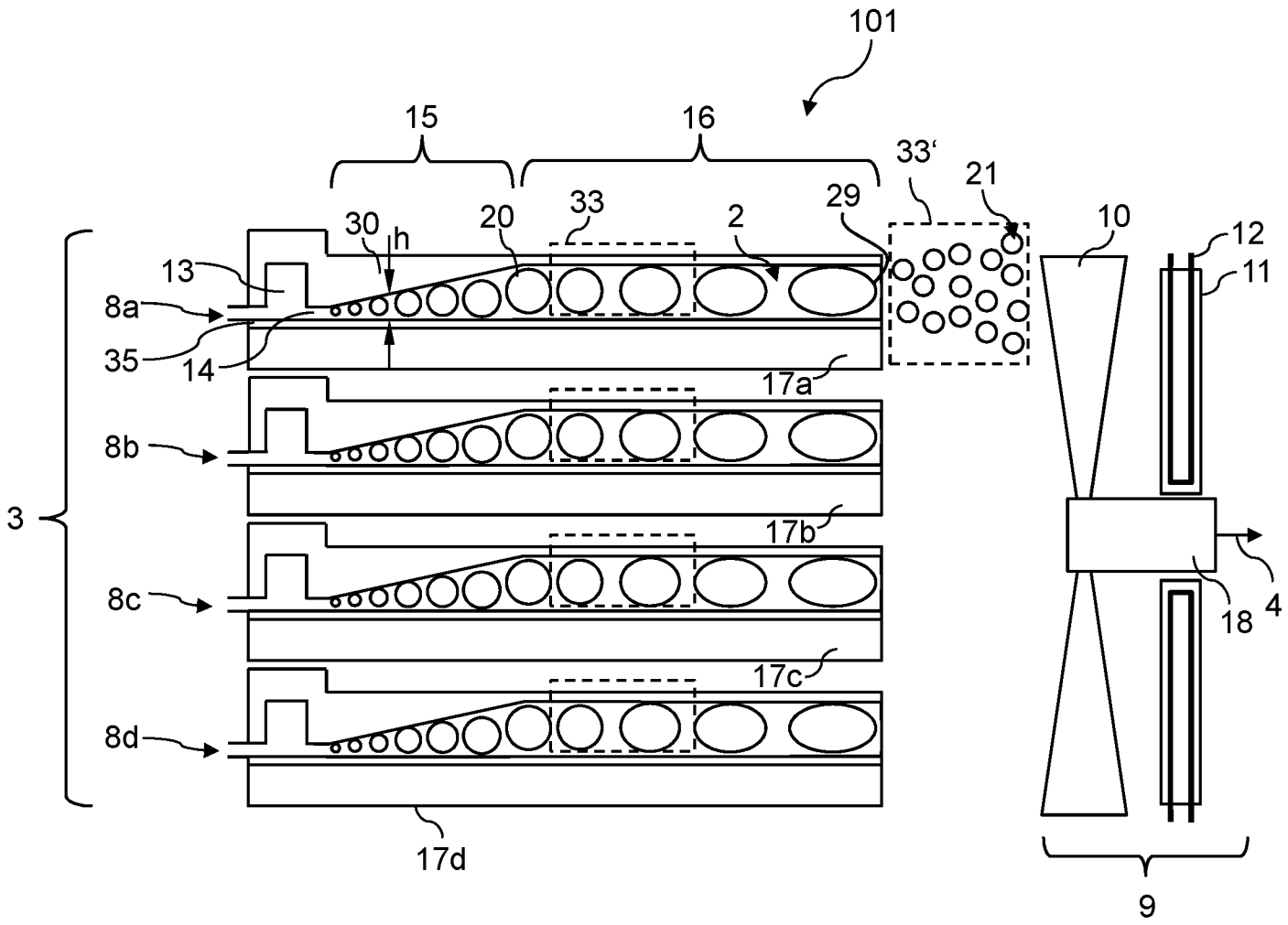
FIG. 6 shows a schematic cross section view of a further embodiment of a device for converting heat into mechanical energy according to an embodiment.

FIG. 6 shows a schematic cross section view of a further embodiment of a device 101 for converting heat into mechanical energy 4. The device 101 shown in FIG. 6 is similar to the device 100 shown in FIG. 3. The device 101 in FIG. 6 includes a plurality of channel flow boilers 8*a*, 8*b*, 8*c*, and 8*d*. Each channel flow boiler 8*a*, 8*b*, 8*c*, 8*d* includes channels 2 arranged parallel to another and a plurality of heating elements 17*a*, 17*b*, 17*c*, 17*d* arranged adjacent to the plurality of parallel channels 2. In FIG. 6 only the uppermost channel flow boiler 8 is provided with reference signs corresponding to the elements shown in FIG. 3 with respect to a single channel flow boiler.

The number of the channel flow boilers 8 can range from 5 to 100,000, for example. Further, an arrangement of the plurality of channel flow boilers 3 depends on the geometry of the expansion device 9 or turbine 23. However, depending on the geometry of a turbine, even more than 100,000 channel flow boilers 8*a*, 8*b*, 8*c*, 8*d* can be used for matching the geometry of the turbine. The outlet 29 of the channel flow boilers 8*a*, 8*b*, 8*c*, 8*d* are directed towards the first stage or rotor 10 of the subsequent turbine device of an expansion device 9.

Figure 7:
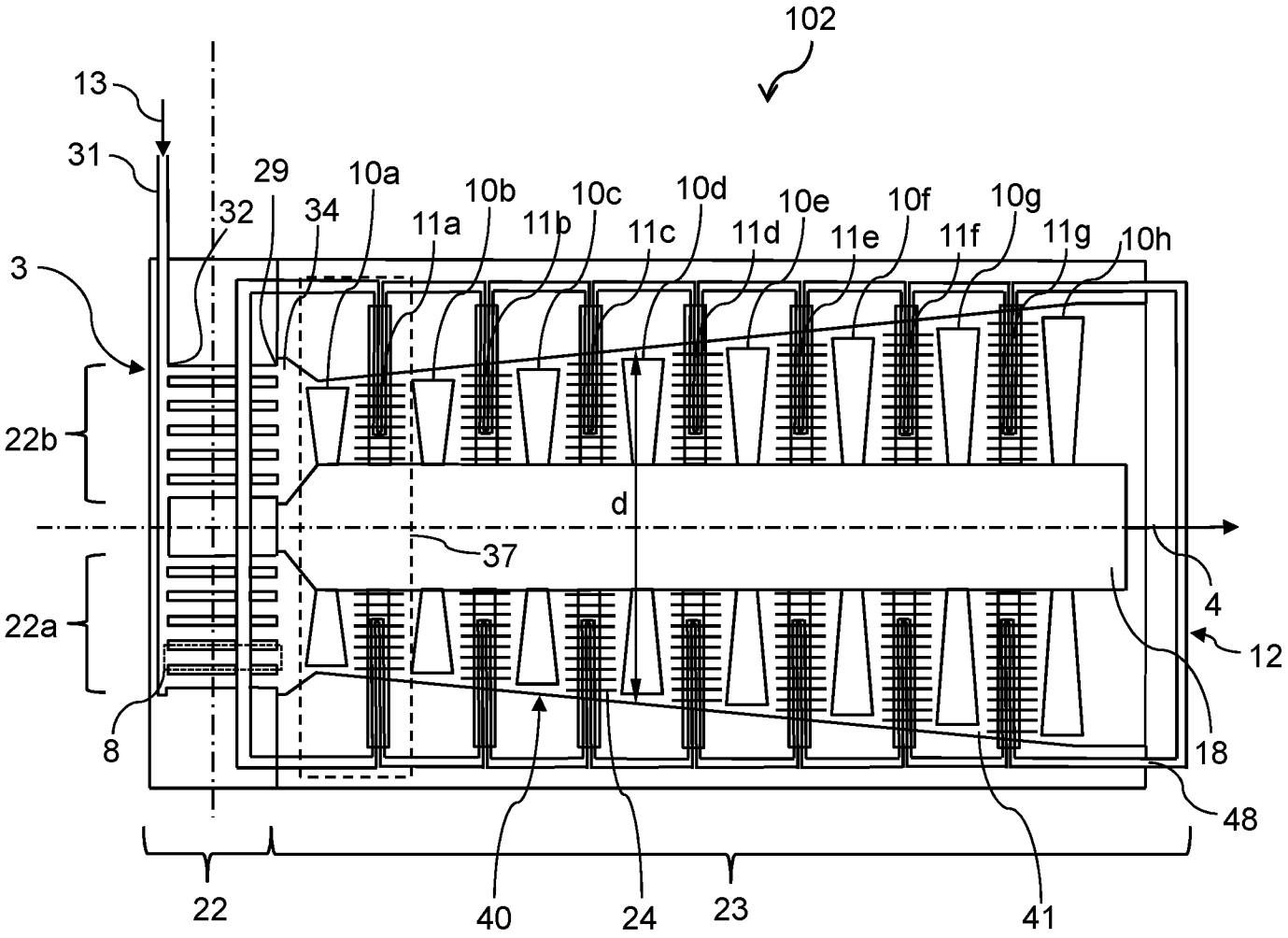
FIG. 7 shows a schematic cross section view of a further expansion device according to an embodiment.

FIG. 7 shows a schematic cross section view of a device 102 for converting heat into mechanical energy according to another embodiment. The device 102 includes a boiler stage 22 and a turbine 23. The boiler stage 22 includes a first boiler section 22*a* and a second boiler section 22*b*, wherein each boiler section 22*a*, 22*b* includes a plurality of channel flow boilers 3. The number of boiler sections 22*a*, 22*b* and the geometrical arrangement of the boiler sections 22*a*, 22*b* can depend on the size and geometry of the subsequent turbine 23. The plurality of channel flow boilers 3 are indicated by dashed lines in FIG. 7 and the inner structure of the channel flow boilers 3, such as the nozzle, the channel, the heating element etc. are omitted. Each channel flow boiler of the plurality of channel flow boilers 3 is similar to the boiling device shown in FIG. 3 and the plurality of channel flow boilers 3 is similar to the plurality of channel flow boilers shown in FIG. 6.

A supply line 31 supplies the working fluid 13 via inlet 32 to each channel flow boiler. As described above with regard to FIG. 3, a liquid-gas mixture is generated in each channel flow boiler and exits the channel flow boiler at the outlet 29. In FIG. 7 only the inlet 32 and the outlet 29 of the uppermost channel flow boiler are provided with reference signs. After exiting the channel flow boiler, the liquid-gas mixture enters the turbine 23 at the turbine inlet 34. The turbine inlet 34 resembles a ring surrounding the shaft or axis 18 on which movable rotor elements or rotor blades 10*a* to 10*h* are mounted.

The turbine 23 includes a plurality of subsequent stages. Each stage has at least one movable rotor element 10*a* to 10*h* adapted to at least partially convert the internal and/or kinetic energy of the liquid-gas mixture into mechanical energy 4. Further, each stage of the turbine 23 includes a heatable stator element 11*a* to 11*g* adapted to supply the heat to the liquid-gas mixture. The dashed line indicates the first stage 37 of the turbine 23, which includes the rotor blade 10*a* and the stator element 11*a*. Each stator element 11*a* to 11*g* is arranged downstream of the respective moveable rotor element 10*a* to 10*g* with respect to the flow of the liquid-gas mixture. Each stator element 11*a* to 11*g* includes a heat exchanger arrangement which is adapted to supply the heat to the expanding liquid-gas mixture. The heat exchanger arrangement includes a conduit 48 through which a heat carrying fluid is guided. In order to facilitate a heat exchange between the liquid-gas mixture and each stator element 11*a* to 11*g*, each stator element 11*a* to 11*g* includes a plurality of fins 24 adapted to exchange heat with the liquid-gas mixtures.

An inner wall 40 of the turbine 23 is arranged in such a way that an inner expansion space 41, in which the liquid-gas mixture expands, increases. This accounts for the increasing volume of the expanding liquid-gas mixture, when flowing from the inlet 34 of the turbine 23 to an outlet 47 of the turbine 23. Accordingly, a size of each rotor element 10*a* to 10*h* and a size of each stator 11*a* to 11*g* are adapted to the inner expansion space 41 of the turbine 23. For example, a diameter d of the expansion space 41 can be between 10 cm and 5 cm at the first stage 37 and between 20 cm and 100 cm at the final stage of the turbine 23. However, depending on the power of the turbine, the diameters of the turbine can be larger, e.g. between 2 m and 10 m or even more. Further, a length of each heatable stator element 11*a* to 11*g* in the flow direction can be chosen such that a heat transfer between each stator element 11*a* to 11*g* and the liquid-gas mixture is maximized.

Investigations of the applicant show that, if the liquid-gas mixture enters the turbine 23 at the ring shaped inlet 34 with a pressure of 1709 mbar and a temperature of 115° C., the temperature of the expanding liquid-gas mixture can be maintained, when flowing from the inlet 34 of the turbine 23 to a second to last stage. In FIG. 7, the second to last stage corresponds to rotor element 10*g* and heatable stator element 11*g*. Thus, the expansion of the working fluid 13 in the turbine 23 is approximately isothermal up to and including the second to last stage. The investigations show further that the liquid phase in the liquid-gas mixture is completely transferred into the gaseous phase after passaging the second to last stage. Therefore, the working fluid 13 is expanded adiabatically in the final stage of the turbine 23. In FIG. 7, the final stage corresponds to the rotor element 10*h*. After the final expansion, the working fluid exits the turbine 23 with a pressure of 80 mbar and a temperature of 41.5° C. Other temperatures and pressures can be contemplated.

Figure 8:
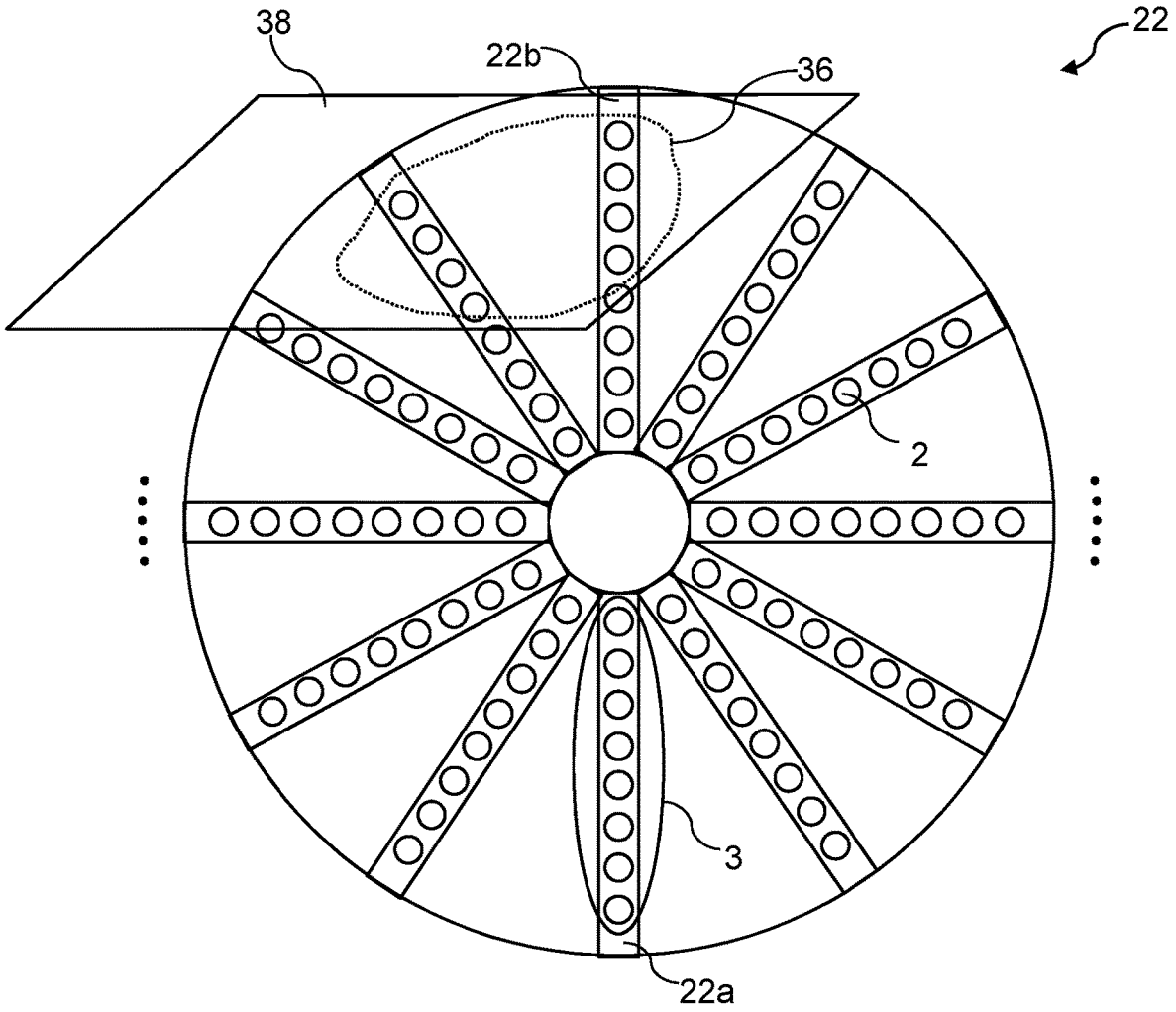
FIG. 8 shows a schematic cross sectional top view of a boiling device according to an embodiment.

FIG. 8 shows a schematic cross sectional top view of the boiler 22 along the dash dotted line in FIG. 7. The boiler stage 22 includes a plurality of boiler sections 22*a*, 22*b*. Each boiler section 22*a*, 22*b* includes a plurality of channel flow boilers 3 having each a channel 2. In particular, each channel flow boiler of the plurality of channel flow boilers 3 is similar to the boiling device shown in FIG. 3. The plurality of boiler sections 22*a*, 22*b* are arranged in such a way that a circular geometry of a turbine inlet is approximated. In particular, the plurality of boiler sections 22*a*, 22*b* are arranged such that droplets of the liquid phase of the liquid-gas mixture form a homogenous flow field downstream of the outlets of each channel 2. It is emphasized that the arrangement shown in FIG. 8 is merely schematic. In order to achieve a homogenous flow field, for example, a density of the channels 2 close to a shaft of the turbine can be lower than at an outer area. Another arrangement for achieving a homogenous flow field can be a hexagonal arrangement of the boiler stages 22*a*, 22*b*.

An optional closing element 38 is provided. The closing element 38 is adapted to close off a plurality 36 of channels 2. The closing element 38 allows for tuning an amount of the liquid-gas mixture generated in the boiling device for example during a partial load operation of the turbine 23. Alternatively or additionally, a flow rate of the working fluid in each channel 2 can be tuned.

Figure 9:
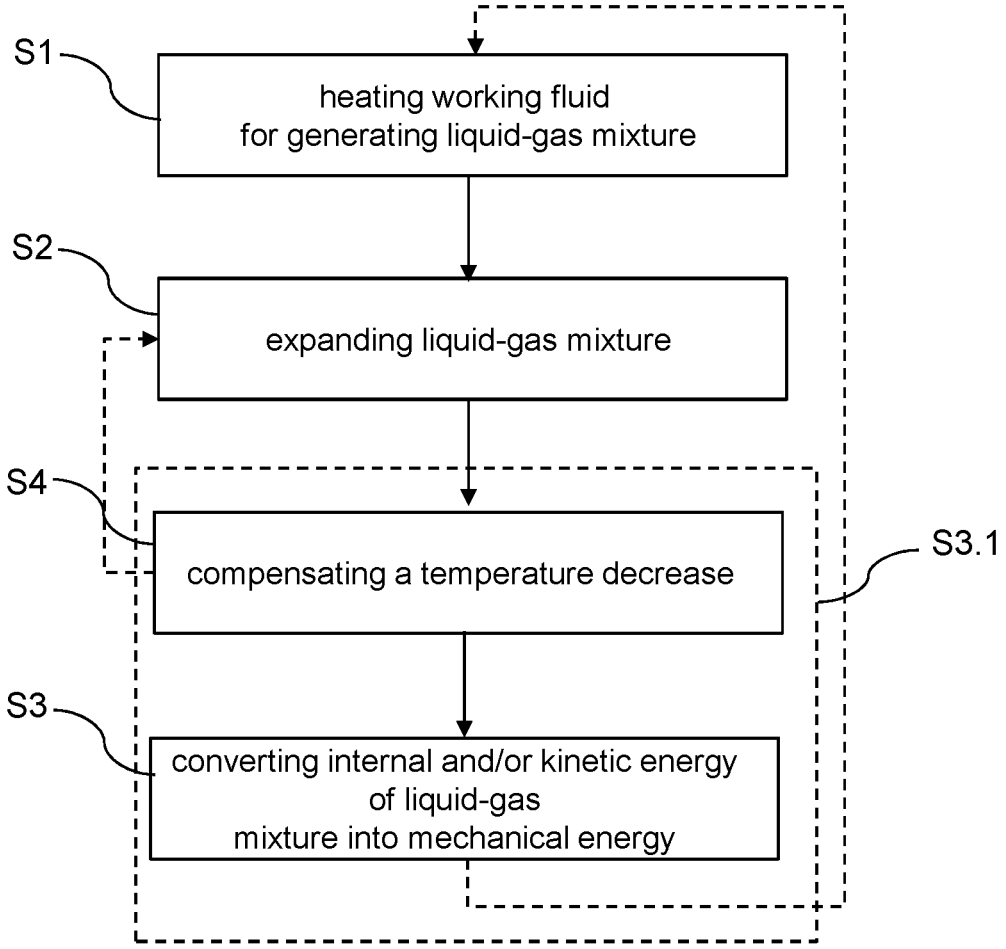
FIG. 9 shows a flow chart of a method for converting heat into mechanical energy according to an embodiment.

FIG. 9 shows a flow chart of a method for converting heat into mechanical energy according to an embodiment. The method includes several steps (S1-S4). The method steps are not necessarily performed in the sequence depicted in the flow chart of FIG. 9. One can execute some steps contemporaneously, for example. First, a working fluid is heated for generating a liquid-gas mixture (step S1). This can be performed in a boiling device 8, for example channel flow boiler 8 shown in FIG. 3 or FIG. 6.

The generated liquid-gas mixture is then expanded (step S2). Due to the expansion of the liquid-gas mixture and a further evaporation of a fraction of the liquid phase in the liquid-gas mixture, the temperature of the liquid-gas mixture decreases. This temperature decrease is at least partially compensated by supplying heat to the liquid-gas mixture in step S3. The internal and/or kinetic energy of the liquid-gas mixture is at least partially converted into mechanical energy associated with the movable element (step S4). For example, expansion of the liquid-gas mixture can be performed in an expansion device such as a multistage turbine 23 shown in FIG. 4 or FIG. 7. The internal and/or kinetic energy of the liquid-gas mixture is then converted into mechanical energy. In particular, the mechanical energy is associated with a movable element of the expansion device such as a movable rotor 10 of the turbine 23, e.g. rotates and drives a shaft (see, for example, FIG. 3). In particular, referring to FIG. 9, the steps 3 and 4 are preferably performed contemporaneously (optional step S3.1). In embodiments, a combined device including a boiling, heating and/or expanding functionality can be employed for step S3.1.

Due to the at least partial compensation of the temperature decrease caused by the expansion of the liquid-gas mixture and the further evaporation of the fraction of the liquid phase, the expansion of the liquid-gas mixture is approximately isothermal.

In particular, by repeating the sequence of steps S2-S4 a) expanding the liquid-gas mixture; b) compensating at least partially a temperature decrease of the expanding liquid-gas mixture by supplying heat to the liquid-gas mixture; c) converting the internal and/or kinetic energy of the liquid-gas mixture into mechanical energy, for example in a multistage turbine, the efficiency of the energy conversion from heat into mechanical energy can be increased.

Further, the method can be optionally utilized in a thermodynamic cycle process. In this case, the entire method can be repeated, as indicated with the dashed arrow. For example, the method can be employed in a thermodynamic cycle process used for driving an electrical generator.

Figure 10:
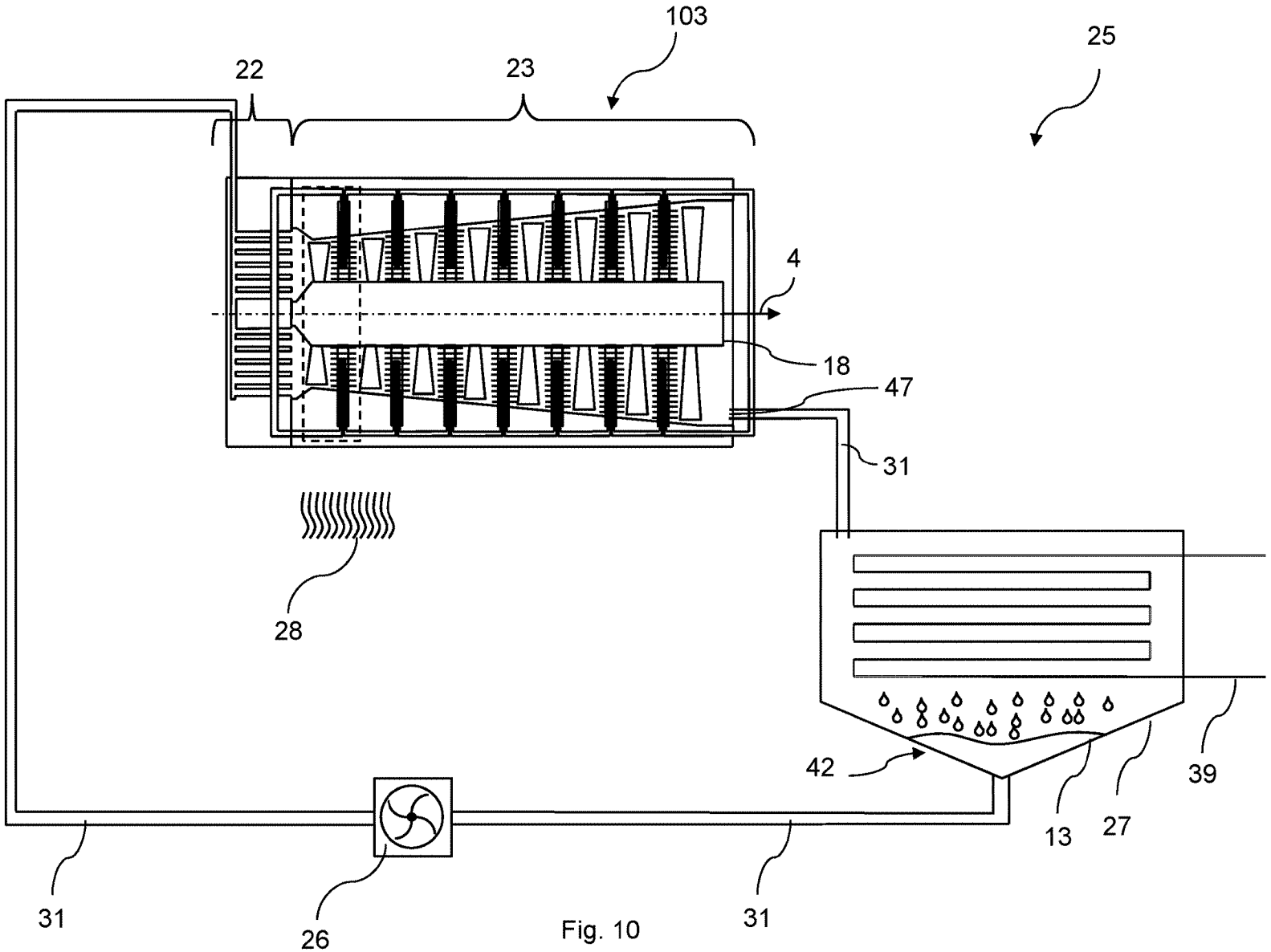
FIG. 10 shows a schematic view of an engine according to an embodiment.

FIG. 10 shows a schematic view of an engine 25 according to an embodiment. The engine 25 includes a working fluid 13, a compression unit or pump 26, a condensation unit or condenser 27, a working fluid reservoir 42 and a device 103 for converting heat into mechanical energy 4. The mechanical energy 4 can be utilized by driving an electrical generator via a turbine shaft 18.

The engine 25 is adapted to perform the modified thermodynamic cycle shown in FIG. 5. The working fluid 13 is compressed in the pump 26 and guided via a supply line 31 to the boiler stage 22. The device 103 is, for example an embodiment as shown in FIG. 7. The boiler stage 22 of the device 103 generates a liquid-gas mixture which is subsequently expanded and reheated in the turbine 23. An approximately isothermal expansion in the turbine 23 is achieved by compensating a temperature decrease due to the adiabatic expansion of the working fluid and a further evaporation of a fraction of the liquid phase of the liquid-gas mixture. After the remaining liquid phase in the liquid-gas mixture is evaporated, the working fluid undergoes a final adiabatic expansion in a final stage of the turbine 23 and exits the device 103 at the turbine outlet 47. The working fluid is condensed into a liquid phase in the condenser 27. In particular, the condenser 27 includes a heat exchanger 39 which is adapted to exchange heat between the working fluid 13 and a carrier fluid guided in the heat exchanger 39. The condensed working fluid 13 is collected in the working fluid reservoir 42. Although the working fluid reservoir 42 is shown in FIG. 10 in combination with the condenser 27, it can alternatively be a separate unit of the engine 25.

Furthermore, the heat supplied to the working fluid in the boiler stage 22 and supplied to the liquid-gas mixture in the turbine 23 is provided by a heat source 28. The heat source 28 can for example be solar thermal energy or industrial waste heat.

It is understood that the depicted embodiments can be modified without departing from the general concept depicted in this disclosure. In particular, the number and form of the modules, chambers, membranes, conduits etc. can vary according to the specific application of the system.

The invention claimed is:

1. A device for converting heat into mechanical energy, the device comprising:

a channel flow boiler having at least one channel adapted to heat a working fluid for generating a liquid-gas mixture;

a turbine adapted to expand the liquid-gas mixture, wherein the turbine has an inner volume, and wherein the inner volume is configured to allow the liquid gas mixture to increase in volume as it traverses the inner volume of the turbine along a flow direction; and wherein the turbine comprises a rotor, the rotor arranged such that the liquid-gas mixture at least partially converts a kinetic energy of the liquid-gas mixture into mechanical energy associated with the rotor;

wherein the at least one channel comprises a first part having a first cross section in a direction perpendicular to the flow direction of the working fluid and a second part having a second cross section in the direction perpendicular to the flow direction, wherein the first cross section is smaller than the second cross section;

wherein the channel flow boiler and the turbine are adapted to supply heat to the liquid-gas mixture and wherein the liquid gas mixture traverses the channel flow boiler prior to traversing the turbine, and wherein the channel flow boiler is further adapted to accelerate the liquid-gas mixture along a channel direction (y), wherein the channel direction (y) of the channel flow boiler and a rotational axis (Y) of the rotor are parallel to one another; and wherein the channel flow boiler and the turbine have a comparable size.

2. The device according to claim 1, wherein the channel flow boiler further comprises at least one heating element arranged adjacent to the at least one channel, wherein the working fluid is guided through the at least one channel and simultaneously heated by the at least one heating element for generating the liquid-gas mixture thereby increasing the kinetic energy of the working fluid.

3. The device according to claim 1, wherein the first cross section increases along the first part and wherein the second cross section is constant.

4. The device according to claim 1, wherein the at least one channel comprises a plurality of channels arranged parallel to one another and a plurality of heating elements arranged adjacent to the plurality of parallel channels, and wherein the working fluid is guided through the plurality of channels and simultaneously heated by the plurality of heating elements for generating and accelerating the liquid-gas mixture.

5. The device according to claim 4, wherein the channel flow boiler further comprises at least one valve adapted to close off a group of the plurality of channels of the channel flow boiler for tuning an amount of the liquid-gas mixture generated and accelerated through the channel flow boiler.

6. The device according to claim 1, wherein the heat supplied to the liquid-gas mixture by the turbine at least partially compensates for a temperature decrease of the liquid-gas mixture in the turbine for reaching an isothermal expansion.

7. The device according to claim 1, wherein the channel flow boiler and the turbine comprises a heat exchanger arrangement adapted to supply the heat to the liquid gas mixture.

8. The device according to claim 1, wherein the turbine further comprises at least one heatable stator element adapted to supply the heat to the liquid-gas mixture.

9. The device according to claim 1, wherein the turbine comprises a plurality of subsequent stages, and wherein each stage has a movable rotor element adapted to at least partially convert the kinetic energy of the liquid-gas mixture into mechanical energy and a heatable stator element adapted to supply the heat to the liquid-gas mixture.

10. The device according the claim 8, wherein the heatable stator element comprises a plurality of fins adapted to exchange heat with the liquid-gas mixture.

11. The device according to claim 1, wherein the channel flow boiler is adapted to generate the liquid-gas mixture having a vapor quality between 10% and 90%.

12. The device according to claim 1, wherein the channel flow boiler is adapted to generate the liquid-gas mixture having between 0.001% and 1% of liquid per volume.

13. A method for converting heat into mechanical energy, the method comprising:

heating a working fluid for generating a liquid-gas mixture;

expanding the liquid-gas mixture; and converting a kinetic energy of the liquid-gas mixture into mechanical energy associated with a rotor, wherein the expanding occurs in a turbine, and wherein the heating occurs in a channel flow boiler and in the turbine;

wherein the method is operated as a thermodynamic cycle such that the expansion of the liquid-gas mixture is isothermal;

wherein the at least one channel comprises a first part having a first cross section in a direction perpendicular to a flow direction of the working fluid and a second part having a second cross section in the direction perpendicular to the flow direction, wherein the first cross section is smaller than the second cross section;

wherein the channel flow boiler and the turbine have a comparable size, and wherein the channel flow boiler is further adapted to accelerate the liquid-gas mixture along a channel direction (y), wherein the channel direction (y) of the channel flow boiler and a rotational axis (Y) of the rotor are parallel to one another; and wherein the liquid-gas mixture increases in volume.

14. The method according to claim 13, wherein the step of heating the working fluid for generating the liquid-gas mixture further comprises accelerating the liquid-gas mixture.

15. The method according to claim 13, wherein the step of converting the kinetic energy of the liquid-gas mixture into mechanical energy associated with the rotor further comprises supplying heat to the liquid-gas mixture.

16. The method according to claim 13, the method further comprising: compensating at least partially for a temperature decrease of the expanding liquid-gas mixture by supplying heat to the liquid-gas mixture.

17. The method according to claim 16, wherein the method includes repeating the steps of:

expanding the liquid-gas mixture;

compensating at least partially for the temperature decrease of the expanding liquid-gas mixture by supplying heat to the liquid-gas mixture; and converting the kinetic energy of the liquid-gas mixture into mechanical energy.

18. An engine comprising:

a working fluid;

a pump;

a condenser;

a channel flow boiler having at least one channel adapted to heat a working fluid for generating a liquid-gas mixture, a turbine adapted to expand the liquid-gas mixture, wherein the turbine has an inner volume, and wherein the inner volume is configured to allow the liquid gas mixture to increase in volume as it traverses the inner volume of the turbine along a flow direction;

wherein the turbine comprises a rotor, the rotor arranged such that the expanding liquid-gas mixture at least partially converts a kinetic energy of the liquid-gas mixture into mechanical energy associated with the rotor;

wherein the at least one channel comprises a first part having a first cross section in a direction perpendicular to the flow direction of the working fluid and a second part having a second cross section in the direction perpendicular to the flow direction, wherein the first cross section is smaller than the second cross section;

wherein the channel flow boiler and the turbine are adapted to supply heat to the liquid-gas mixture, and wherein the channel flow boiler is further adapted to accelerate the liquid-gas mixture along a channel direction (y), wherein the channel direction (y) of the channel flow boiler and a rotational axis (Y) of the rotor are parallel to one another, and wherein the liquid gas mixture traverses the channel flow boiler prior to traversing the turbine; and wherein the channel flow boiler and the turbine have a comparable size.

19. The engine according to claim 18, the engine further comprising:

a heat source for supplying the heat to the liquid-gas mixture in the turbine and for supplying the heat to the working fluid in the channel flow boiler.

* * * * *